US006300260B1

(12) United States Patent
Iwasa et al.

(10) Patent No.: US 6,300,260 B1
(45) Date of Patent: Oct. 9, 2001

(54) POLYESTER FABRIC FOR INK JET RECORDING AND PROCESS FOR MANUFACTURING THE SAME

(75) Inventors: Youichi Iwasa; Toshiharu Katsuki; Hiroyuki Saito, all of Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 09/334,209

(22) Filed: Jun. 15, 1999

(51) Int. Cl.[7] ..... B32B 27/04; B32B 27/12; B32B 27/02; B32B 5/16; D04H 1/00

(52) U.S. Cl. ..... 442/164; 442/118; 442/417

(58) Field of Search ..... 442/164, 118, 442/417

(56) References Cited

U.S. PATENT DOCUMENTS 4,472,230 * 9/1984 Sachs et al. ..... 156/307.3
4,472,550 * 9/1984 Reiff et al. ..... 524/589
4,528,153 * 7/1985 Scholl et al. ..... 264/109

FOREIGN PATENT DOCUMENTS

08002688-B * 8/1996 (JP) ..... B41M/5/00

* cited by examiner

*Primary Examiner*—Blaine Copenheaver
*Assistant Examiner*—Christopher C. Pratt
(74) *Attorney, Agent, or Firm*—Dilworth & Barrese LLP

(57) ABSTRACT

Provided is a polyester fabric for ink jet recording which is suitable for outdoor use. A treating solution comprising a water-swelling resin (A) comprising a reaction product of a polycarbonate polyol and a polyisocyanate compound and having a sulfite group at the side chain and a number average molecular weight of 20,000 to 100,000; a water-swelling resin (B) comprising a reaction product of a polycarbonate polyol and a polyisocyanate compound and having a sulfite group at the side chain and a number average molecular weight of 5,000 to 15,000, wherein a blocking agent is reacted with active isocyanate groups positioned at both terminals of the water-swelling resin to mask the terminal isocyanates; and water-retentive microparticles (C) is applied to a polyester fabric, followed by heat-treating to form the fabric for ink jet recording.

18 Claims, No Drawings

POLYESTER FABRIC FOR INK JET RECORDING AND PROCESS FOR MANUFACTURING THE SAME

FIELD OF THE INVENTION

The present invention relates to a recording material for ink jet and, particularly, to a polyester fabric used in the applications, such as a suspended curtain, a banner, and a cloth signboard, which are large-sized and require strength.

BACKGROUND OF THE INVENTION

Industrial ink jet machines for large-scale full color printing with 60 cm to 2 m width have been brought to the market place in recent years. As materials to be printed in these applications, recording materials produced by surface-treating paper or a plastic sheet have dominated in the market. Polyester fabrics are light-weight and flexibility and have high durability and high resistance to tensile tearing and are therefore suitable as base materials for large printing products. These fabrics, however, have irregularities larger than paper or a plastic sheet which have a smooth surface. Hence colorant particles in ink are diffused on the surface of the fabric so that the density on the surface is liable to be seen thin. It is therefore necessary to design a specific ink image receiving layer for fabrics.

While, inks which are used in applications requiring high durability and produced by dispersing a water-insoluble pigment in water are superior durability against wind and rain, UV-rays, $NO_x$ gas and the like but are inferior in print density (OD value) to inks produced by dispersing a water-soluble pigment.

Restrictions on the physical properties and dispersibility of an ink jet ink offer a difficulty in an extreme improvement in ink density. In order to obtain the same density as that of an ink containing a water-soluble pigment by using an ink containing a water-insoluble pigment, it is necessary to make a specific design for the ink using a water-insoluble pigment, which enables an increase in the amount of ink, absorption of the increased ink, prevention of the strike through and development of a high density color on the surface.

The fabric , different from paper and resin sheets, is light-weight, tough, flexibility and elastic. The fabric is very convenient because, putting these physical properties of the fabric, it can be stored and carried while it is folded. However, in a case that the ink image receiving layer lacks in adhesion to the fabric, it readily peels off and falls out, producing whitely faded portions. It is therefore necessary to make specific designs for an ink image receiving layer taking adhesion to a polyester fabric into full consideration.

Development of those limited in feathering by processing an image receiving layer on the print surface of a synthetic fabric is still ongoing these days. However, these fabric products cause insufficient development in color of the ink using a water-insoluble pigment and only a print image giving a dim impression is obtained. Also, the characteristics of the fabric such as feeling, bending characteristics and strength are insufficiently utilized and hence its application is limited.

An examination has been made to form an receiving image layer by using various chemicals to solve these problems.

For instance, an image receiving layer sheet produced by applying a droplet of mixture of a hydrophilic polymer binder and microparticles of silicic acid are disclosed in JP 52-9074A, JP 55-51583A, JP56-148583A, and JP 58-72495A. Since these image receiving layers consist of a porous structure+a hydrophilic resin, they have high ink absorbance and color-developing capability. However, they have insufficient bending characteristics and elasticity and have insufficient water-resistance in particular. Therefore, they are used in applications limited to paper or film materials and applications of these image receiving layers to the polyester fabric are impractical.

An image receiving layer using a basic latex to improve the water-resistance is disclosed in JP 57-36692A. This image receiving layer, though it is superior in the bending characteristic and in the water-resistance, lacks in water-absorption and has inferior color developing capability when a water-insoluble ink is used and also lacks in long-term weatherability.

Image receiving layers in which high water-absorbance acrylic resin particles are dissolved or dispersed, for instance, in a polymer binder are disclosed in JP 57-173294A, JP 57-191084A and JP63-281885A. In the case of a water-type application solution, it absorbs water and is increased in the viscosity when it is prepared, causing its addition to be difficult. Although such a water-type application solution is superior in the ink absorbance and surface color developing capability, it has insufficient water-resistance and poor adhesion to a fabric. Moreover, the high water-absorption resin is liable to hydrolyze viewing from the weatherability and applications of this image receiving layer to a fabric are impractical.

Further, porous image receiving layers comprising pseudo-boehmite which is a coagulant of a boehmite crystal are disclosed in JP 6-184954A, JP 7-238467A, JP 9-104166A and JP 9-123593A. These porous receiving layer exhibits excellent color developing capability when a water-soluble ink is used. However, in the case of using a water-insoluble ink, when it is intended to obtain sufficient surface density by increasing the amount of ink, feathering along a fabric tends to appear from a lack in the ink absorption capability of the image receiving layer and the ink-drying characteristics and the wetting-wear resistance of the composition are also insufficient, limiting applications of the image receiving layer. The image receiving layer has a gas-discoloring tendency and also poses a problem that an offensive odor remains in the layer due to acetic acid used in the production process.

JP 8-2688B discloses that a fabric is coated with a wetting coagulated film of a polymer obtained by reacting a polyisocyanate compound and a polyol. This receiving layer gives a soft feeling peculiar to the wetting coagulated film and has high bending characteristics, elasticity, wear resistance and water-resistance because of a porous structure and high adhesion to a base material when it is applied to a fabric. However, feathering tends to be caused from lack of the water absorption of the resin and is inferior in color development, limiting its applications.

Other than the above disclosures, there is a disclosure of the use of a water-swelling prepolymer produced by masking, with a block agent, a terminal NCO group of a product produced by reacting a polyether polyol with a polyisocyanate as reported in JP 9-216458A. These prepolymers have excellent surface color developing capability and high adhesion to a fabric. However, these prepolymers have insufficient bending characteristics, poor flexibility and inferior abrasion resistance of the dried film. Because these prepolymers have a water-absorbing portion on a primary chain, they are inferior in the water-resistant strength. Also because they are ether-type polyols, they have poor adhesion to a polyester which is a polar base material. Hence they have low peeling strength and are liable to cause a whited phenomenon on account of falling of a resin also in a print image. Further the weatherability and heat-resistance of a final polymer are inferior and the features of the polyester fabric, that is, the fastness of the polyester fabric cannot be utilized sufficiently.

JP 3-42590B discloses the use of a water-swelling reaction polymer of a polyether-type polyisocyanate, JP 9-99635A discloses the use of a self-emulsion type (anionic) reaction polymer of an isocyanate which polymer has a glass transition point of 60° C. or more, and JP 9-150574A discloses the use of a combination of an aqueous polyolefin dispersion solution, an ethylene type copolymer, and a reaction polymer of a polyisocyanate which polymer contains a sulfite as a hydrophilic group. However, these compositions have excellent surface color developing capability, bending characteristics and elasticity but are inferior in the wetting-wear resistance and adhesion to a polyester fabric. Even if these compositions are cross-linked using a usual cross-linking agent, the adhesion is increased but the water-absorbance and density of the compositions is greatly increased and the feathering is increased.

From these problems, conventional compositions are used for base materials, such as paper, white resin sheets and OHP sheets, which do not require long term fastness as long as several years but cannot be used for a polyester fabric requiring long-term fastness. Compositions satisfying the qualities of recording images, adhesion to a polyester fabric and wear resistance (rubbing strength) in a balanced manner are not obtained yet at present when a water-insoluble pigment is used.

OBJECTS OF THE INVENTION

It is an object of the present invention to provide a polyester fabric for ink jet recording which has high absorbance, provides a uniform image, and exhibits high color density (compatibility of the quality that retains ink in the vicinity of the surface to form an image having high density with the quality that absorbs ink rapidly to make the ink to dry apparently) even when multi-color and high density full color image recording is made and which does not damage the weatherability, wear resistance and bending characteristics and elasticity which are the most important characteristics of an ink jet recording polyester fabric. Another object of the present invention is to provide a process for the production of the polyester fabric.

Specifically, the present invention has an object of providing a polyester fabric for ink jet recording which is suitable for, particularly, outdoor use and a further object of providing a process for the production of the polyester fabric.

SUMMARY OF THE INVENTION

The inventor of the present invention has made earnest studies of the above problems and, as a result, found that the conventional problems can be solved by using a combination of a specific two types of water-swelling resin and water-retentive microparticles to complete the present invention.

According to a first aspect of the present invention, there is provided a polyester fabric for ink jet recording comprising:

a water-swelling resin (A) comprising a reaction product of a polycarbonate polyol and a polyisocyanate compound and having a sulfite group at the side chain and a number average molecular weight of 20,000 to 100,000;

a water-swelling resin (B) comprising a reaction product of a polycarbonate polyol and a polyisocyanate compound and having a sulfite group at the side chain and a number average molecular weight of 5,000 to 15,000, wherein a blocking agent is reacted with active isocyanate groups positioned at both terminals of the water-swelling resin to mask the terminal isocyanates; and water-retentive microparticles (C); the fabric being heat-treated.

In the invention, preferably the water-swelling resin (A) contains 1–5% by weight of the sulfite and the water-swelling rate is in a range between 130 and 180%.

In the invention, preferably the water-swelling resin (B) contains 1–5% by weight of the sulfite and the water-swelling rate is in a range between 120 and 160%.

In the invention, preferably the water-retentive microparticles (C) are selected from the group consisting of microparticles of silicic acid produced by a wetting method, microparticles of water-insoluble collagen, and microparticles of calcium alginate and has a water-absorption capacity of 1.2–3.5 ml/g and an average particle diameter of 10 $\mu$m or less.

In the invention, preferably the ratio (A)/(B) by weight of the water-swelling resin (A) to the water-swelling resin (B) is in a range between 6/4 and 9/1.

In the invention, preferably the ratio ((A)+(B))/(C) by weight of a mixture of the water-swelling resin (A) and the water-swelling resin (B) to the water-retentive microparticles (C) is in a range between 6/4 and 3/7.

According to another aspect of the present invention, there is provided a process for producing a polyester fabric for ink jet recording comprising applying to a polyester fabric a treating solution consisting essentially of:

a water dispersion solution of a water-swelling resin (A) comprising a reaction product of a polycarbonate polyol and a polyisocyanate compound and having a sulfite group at the side chain and a number average molecular weight of 20, 000 to 100,000;

a water dispersion solution of a water-swelling resin (B) comprising a reaction product of a polycarbonate polyol and a polyisocyanate compound and having a sulfite group at the side chain and a number average molecular weight of 5,000 to 15,000, wherein a blocking agent is reacted with active isocyanate groups positioned at both terminals of the water-swelling resin to mask the terminal isocyanates; and water-retentive microparticles (C); and heat-treating the fabric at 120 to 160° C.

In the invention, preferably the water-swelling resin (A) and the water-swelling resin (B) are microparticles having a particle diameter of 10 to 50 nm.

DETAILED DESCRIPTION OF THE INVENTION

The structure of the present invention will be hereinafter described in detail.

The water-swelling resin (A) of the present invention is used after it is made into its water dispersion solution. This water dispersion solution is prepared without adding an emulsifier. The dispersion particle diameter is preferably controlled in a range between 10 and 50 nm thereby obtaining a resin extremely superior in the coating strength, adhesion and the water-resistance to a conventional water dispersion solution containing an emulsifier and having a particle diameter of 100 to 200 nm. It is particularly preferable that the water-swelling resin (A) be water dispersion solution of ultra-micro particles having a particle diameter of 20 to 40 nm. This resin is a so-called hydrosol type and may be produced, for example, by a well-known acetone method or a prepolymer method. This resin can be produced, for instance, by an addition reaction of a polyisocyanate compound having two or more NCO groups with a polycarbonate polyol having two or more active hydrogens, namely a polycarbopolyol to synthesize a prepolymer having an active NCO group at its terminal and by reacting the prepolymer with a low molecular compound containing a sulfite as a hydrophilic group and two or more active hydrogens to grow a chain to produce a high molecular weight polymer, followed by dispersing by self-emulsification.

The polyisocyanate compound is a compound having at least two NCO groups. Examples of the polyisocyanate which is preferably used in the present invention include 2,4-tolylene diisocyanate (2, 4-TDI), 2, 6-tolylene diisocyanate (2,6-TDI), m-phenylene diisocyanate, p-phenylene diisocyanate, 4,4'-diphenylmethane diisocyanate (4, 4'-MDI), 2,4'-diphenylmethane diisocyanate (2,4'-MDI), 2,2'-diphenylmethane diisocyanate (2,2'-MDI), 3, 3'-dimethyl-4,4'-biphenylene diisocyanate, 3, 3'-dichloro-4, 4'-biphenylene diisocyanate, 1,5-naphthalene diisocyanate (NDI), 1,5-tetrahydronaphthalene diisocyanate, tetramethylene diisocyanate, 1, 6-hexamethylene diisocyanate (HDI), dodecamethylene diisocyanate, trimethylhexamethylene diisocyanate, 1, 3-cyclohexylene diisocyanate, 1,4-cyclohexylene diisocyanate, xylylene diisocyanate, tetramethylenexylylene diisocyanate, hydrogenated xylylene diisocyanate, lysine diisocyanate, isophorone diisocyanate (IPDI), 4,4'-dicyclohexylmethane diisocyanate (hydrogenated MDI), and 3,3'-dimethyl-4, 4'-dicyclohexylmethane diisocyanate. Among these compounds, those using an aliphatic or alicyclic polyisocyanate are particularly preferable in view of the weatherability and long-term stability, such as $NO_x$ resistance, of the resin. These compounds may be used either singly or in combinations of two or more.

As the polycarbonate polyol, a polycarbonate polyol having at least two active hydrogen is used in the present invention. Examples of the polycarbonate include compounds obtained by reacting a glycol such as 1,4-butane diol, 1,6-hexane diol, cyclohexane dimethanol and diethylene glycol or trimethylol propane with diphenyl carbonate and phosgene. Each of these compounds can form a polymer having excellent weatherability, hydrolysis resistance, heat resistance, and mildew-proof capability. Each of these compounds can also form a polymer which is extremely adhesive to a polyester which is a polar substrate due to a carbonyl group contained in the polycarbonate structure. These compounds ensure that falling of a resin is hardly caused thereby preventing whited and deteriorated phenomena of a print image.

These compounds may be used either singly or in combinations of two or more.

The sulfite group positioned at the side chain is derived from a low molecular weight compound containing a sulfite which is a hydrophilic group and at least two active hydrogens. Examples of the low molecular weight compound include metal salts of hydrazine sulfite and metal salts of ethylenediamine sulfite. These compounds may be used either singly or in combinations of two or more.

The content of the sulfite group (—$SO_3M$, wherein M represents an alkali metal) which is a hydrophilic group is desirably designed to be in a range between 1 and 5% by weight in a resin structure. When the content is less than 1% by weight, the ink absorbance of an image receiving layer is reduced whereas when the content exceeds 5% by weight, the wetting-wear resistance of the image receiving layer is significantly reduced and hence this is unpractical.

The number average molecular weight of the water-swelling resin (A) must be in a range between 20,000 and 100,000. When the number average molecular weight is 20,000 or less, the flexibility and durability of the resin are inferior and a brittle resin lacking in filming capability, flexibility, strength and heat resistance tends to be produced. On the other hand, a number average molecular weight exceeding 100,000 is impractical.

The water-swelling rate is preferably in a range between 130 and 180%. The water-swelling mentioned here means the ratio of the weights of a resin coating before and after the resin coating which is dried at 160° C. for 3 minutes is dipped in water at 25° C. for one hour. In the case where the water-swelling rate is in a range between 130 and 180%, the dried resin coating has a water-absorbing power of 30–80% of own weight. When the water-swelling rate is 130% or less, the absolute ink-absorbing power is inferior whereas when the water-swelling rate exceeds 180%, the water-resistance of the dried coating is significantly reduced.

The glass transition point is preferably −10° C. or less. When the glass transition temperature is higher than −10° C., the bending characteristics and flexibility of the dried resin coating are reduced, posing the problem that the resin coating lacks in the peeling resistance and in the flexibility and elasticity which are the characteristics of the fabric.

The water-swelling resin (B) can be produced by a well-known method.

To state more specifically, a polyisocyanate compound having at least two NCO groups is reacted with a polycarbonate polyol having at least two active hydrogens to form a low molecular weight product having active NCO groups at both terminals of a molecule. The low molecular weight product is reacted with a low molecular weight compound having a sulfite which is a hydrophilic group and at least two hydrogens to form a prepolymer having active NCO groups at both terminals of a molecule. A blocking agent is reacted with the prepolymer to block the terminals thereby obtaining the water-swelling resin (B). When the water-swelling resin (B) is applied to a fabric, it is self-emulsified (soap-free) to form a water dispersion solution of the water-swelling resin (B).

The particle diameter of the water-swelling resin (B) is preferably in a range between 10 and 50 nm.

As examples of the polyisocyanate compound having at least two NCO groups, in addition to the aforementioned isocyanate compounds having two NCO groups, isocyanate compounds having three or more NCO groups such as 1-methyl-2,4,6-triisocyanate, naphthalene-1,3, 7-triisocyanate and triphenylmethane-4,4',4"-triisocyanate may be given. Among these compounds, particularly, those using aliphatic or alicyclic isocyanates are preferable in light of the weatherability of the resin and the long-term stability such as $NO_x$ resistance. These compounds may be used either independently or in combinations of two or more.

As the polycarbonate polyol having at least two active hydrogens, each of the aforementioned compounds may be used as it is. These compounds may be used either independently or in combinations of two or more.

It is necessary that the number average molecular weight of the water-swelling resin (B) is between 5000 and 15000.

A number average molecular weight less than 5000 causes an excessive reduction in the flexibility, strength and heat resistance, rendering the product resin to be brittle and to lack in adhesion to a fabric and in strength even if the resin (B) is used as a heat sensitive gelling agent. On the other hand, the number average molecular weight greater than 15000 renders the gelling structure coarse and causes reduced adhesion to a fabric and low water-resistance though the flexibility is maintained.

As the agent blocking NCO groups, any compound which can leave by heating to reproduce NCO groups may be used and well-known compounds may be optionally used. For example, phenols; lower alcohols; active methylene compounds such as ethyl acetoacetate, acetylacetone and diethyl malonate; lactams such as ε-caprolactam; oximes such as methyl ethyl ketooxime, butanone oxime, cyclohexanone oxime, bisulfites, or aliphatic mercaptans such as methylmercaptan and ethylmercaptan may be used. Among these compounds, active methylene compounds having a decomposition temperature of 130–140° C. are most convenient. These compounds may be used either independently or in combinations of two or more.

It is preferable that the ratio by weight of the water-swelling resin A to the water-swelling resin B, namely A/B=6/4–9/1. A too small amount of the resin A brings about a poor film formation function and induces a reduction in the flexibility and in ink-absorbance whereby feathering tends to be caused. On the other hand, a too small amount of the resin B causes poor adhesion to a polyester.

Examples of the water-retentive microparticles include well-known retentive microparticles such as microparticles of silicic acid produced by a wetting method (for instance, Sylysia 350 manufactured by Fuji Silysia Chemical Co, .Ltd.), water-insoluble collagen microparticles (for instance, Triazet CX260-1, manufactured by Showa Denko, K. K.) and microparticles of calcium alginate (for instance, Frabicafine SF-W, manufactured by Taiyo Kagaku Co., Ltd.).

The average particle diameter of the water-retentive microparticles is preferably 10 μm or less. An average particle diameter greater than 10 μm damages the strength of the composition and the surface smoothness of the image receiving layer, causing peeling and reduced density.

The water absorbance of the water-retentive microparticles is preferably in a range between 1.2 and 3.5 ml/g.

It is desirable that the ratio by weight of the sum of the water-swelling resins A and B to the water-retentive microparticles C, namely (A+B)/C=6/4–3/7. If the ratio of the water-retentive microparticles is lower than 4, the ink-absorbance is insufficient and feathering and a reduction in the density are induced. The ratio of the retentive microparticles larger than 7 tends to cause reduced coating strength, reduced adhesion to a polyester fabric and occurrences of the strike through of ink and the like.

As the polyester fabric, a variety of polyester fabrics such as polyethylene terephthalate and polybutylene terephthalate may be adopted. Among these fabrics, it is particularly preferable to use a plane weave fabric of polyester in view of the strength and durability. The tensile tearing strengths both in longitudinal and lateral directions are preferably 1 kg or more (JIS L1096 pendulum method) and more preferably 2 kg or more. A tensile tearing strength less than 1 kg is the same level as that of a film and is hence impractical for a fabric.

The fabric of the present invention which is produced by applying a treating solution comprising the resin A, the resin B and the microparticles C and by heat-treating the treating solution has an ink absorbance as high as $1.4\times10^{-2}$ to $-5.6\times10^{-2}$ μl/mm$^2$.

Among the treating solutions comprising the resin A, the resin B and the microparticles C according to the present invention, a hydrosol composition comprising a high molecular weight flexible resin A and a low molecular weight heat-sensitive gelling-type resin B is utilized as a binder for binding the water-retentive microparticles C with the fabric whereby various problems can be solved.

After a treating solution comprising the resin A, the resin B and the microparticles C is applied to a polyester fabric, it is heated to 120–160° C. to vaporize water to cause a fusion between the polymer microparticles, between the polymer microparticles and the water-retentive microparticles or the polyester fabric and to cause decomposition of terminal blocking agents of the resin B. The active NCO group is thereby reproduced and is reacted with the resin A, the polyester fabric and moisture in air or self-polymerizes to cause a gelling reaction whereby the polymer forms a network. It is considered that such a network structure ensures that a water-swelling and water-insoluble composition having strong adhesion to the fabric can be formed without impairing the flexibility which are the characteristics of the resin A.

When the above heating temperature is 120° C. or less, the decomposition of the blocking agent is not accelerated and the vaporization of water is delayed causing inferior film formation. On the other hand, a heating temperature higher than 160° C. causes decomposition of the blocking agent and excessively rapid vaporization of water, whereby a non-uniform film tends to be formed.

The additives used in the treating solution can be compounded to improve the printability of an ink jet, the weatherability and the fastness of rubbing to the extent that the bending characteristics and the elasticity are not impaired. Examples of the additives include UV-absorbers, antioxidants, anti-foaming agents, leveling agents, viscosity control agents, pH regulating agents, antiflaming agents and biocide.

As the method for the application to the fabric, methods usually used may be adopted. Examples of the application method include a curtain coater method, extrusion coater method, air knife coater method, gravure coater method, blade coater method, roll coater method, rod bar coater method and impregnating method. The application may be made either onto one surface or both surfaces and either locally or onto the whole surface. The amount of the composition to be applied to the fabric is preferably in a range between 10 and 50 g/m$^2$ as a solid.

The composition may be divided into two or more layers to be laminated. When two or more layers are laminated, the total amount to be applied onto the fabric is preferably in a range between 10 and 50 g/m$^2$ as a solid like the above.

As the ink, any of aqueous ink such as reactive dyes and acid dyes and water-insoluble ink such as organic pigments and inorganic pigments may be used. Particularly, a combination with a water-insoluble ink which has poor coloring power and is required to apply in a large amount is most suitable.

As a solvent for ink, each of water and various aqueous organic solvents may be used. Examples of the aqueous organic solvents include polyalkylene glycols such as polyethylene glycol and polypropylene glycol; alkylene glycols having 2–6 alkylene glycol groups such as ethylene glycol, propylene glycol, butylene glycol, triethylene glycol, 1,2,6-hexane triol, thiodiglycol, hexylene glycol and diethylene glycol; lower alkyl ethers of polyhydric alcohols such as glycerol, ethylene glycol methyl ether, diethylene glycol methyl ether, diethylene glycol ethyl ether, triethylene glycol and monomethyl ether; pyrrolidinones such as 2H-pyrrolidinone; and pyrrolidones such as 1-methyl-2-pyrrolidone and 2-pyrrolidone.

It is preferable to use a mixture solvent of water and the above solvent with the view of preventing clogging in a discharge head. The ratio by weight of water to an organic solvent is preferably 50/50 to 99/1 and more preferably 80/20 to 99/1.

As an additive for ink, various well-known additives such as surfactants, antifoaming agents, viscosity control agents, surface tension regulating agents, pH regulating agents and biocide may be added.

The present invention will be explained in more detail by way of examples, which are not intended to be limiting of the present invention. In examples "parts" and "%" indicate "parts by weight" and "% by weight" respectively.

EXAMPLES

Example 1

Synthesis of Water-swelling Resin (A)

A four neck flask equipped with a temperature gauge, a stirrer, a reflux cooler and a nitrogen introducing pipe was charged with 100 parts of 1, 6-hexane polycarbonate diol (Desmophen 2020E, manufactured by Bayer) which had a number average molecular weight of 2,040 and which was fully dehydrated by drying under reduced pressure while melted under heat and was then charged with 303 parts of methyl ethyl ketone and 0.026 parts of dibutyltin dilaurate as a catalyst. Next, 24.7 parts of 4,4'-dicyclohexylmethane diisocyanate (hydrogenated MDI) was added dropwise and the mixture was heated gradually to 80° C. The reaction was continued until the ratio of an NCO group reached the theoretical value while the ratio of an NCO group was measured by titration. When the ratio of an NCO group reached the theoretical value, the system was cooled to 250° C. To the cooled mixture was gradually added 520 parts of 25° C. distilled water in which 5.26 parts of a sodium salt of hydrazine sulfite was dissolved and the temperature of the system was then raised to 40° C. to carry out a chain-growing reaction. When almost no residual NCO group was present, the residual NCO group was completely blocked by n-butylamine to finish the reaction. The resulting product was homogenized and dispersed using a homogenizer such that the average particle diameter was 40 nm, followed by distilling methyl ethyl ketone under reduced pressure to obtain a water dispersion solution of the water-swelling resin A having 20% of a solid, a number average molecular weight of 93,700 and a water-swelling rate of 170%.

Synthesis of water-swelling Resin (B)

198 parts of methyl ethyl ketone and 0.026 parts of a catalyst were introduced into a dehydrated and dried polyol which was the same as that used in the case of the above resin A. Next, 25.6 parts of isophorone diisocyanate (IPDI) was added dropwise and the mixture was heated gradually to 80° C. The reaction was continued until the ratio of an NCO group reached the theoretical value while the ratio of an NCO group was measured appropriately by titration. When the ratio of an NCO group reached the theoretical value, the system was cooled to 25° C. To the cooled mixture was gradually added 308 parts of 25° C. distilled water in which 6.36 parts of a sodium salt of ethylenediamine sulfite was dissolved to carry out a chain-growing reaction. Then, the amount of a residual NCO group in the system was measured and diethyl malonate was added in an amount sufficient to mask the residual NCO group thereby blocking reactive terminal NCO groups to finish the synthesis. The resulting product was homogenized and dispersed using a homogenizer such that the average particle diameter was 35 nm, followed by distilling methyl ethyl ketone under reduced pressure to obtain a water dispersion solution of the water-swelling resin B having 30% of a solid, a number average molecular weight of 11,200 and a water-swelling rate of 160%.

Processing of a Fabric

The following polyester plain weave fabric was used as a substrate.

Density in a longitudinal direction: 60 pieces/inch.

Density in a lateral direction: 60 pieces/inch.

Thread: 300 denier/96 filaments.

Weight: 170 g/m$^2$.

Tensile tearing strength: 7.6 kg in both longitudinal lateral directions.

A treating solution was prepared according to the following formulation.

| Formulation of the treating solution: | |
|---|---|
| Water dispersion solution of the resin (A) (concentration of a solid: 20%) | 100 parts |
| Water dispersion solution of the resin (B) (concentration of a solid: 30%) | 20 parts |
| Microparticles (C) (trademark: Sylysia 350, manufactured by Fuji Silysia Chemical Co., Ltd., particle diameter: 1.8 $\mu$m, water absorbance: 1.6 ml/g) | 26 parts |

A treating solution obtained by mixing the above components was applied to a fabric so that the dried weight was 35 g/m$^2$ by a coating method. The resulting product was, after it was subjected to hot air drying, heat-treated at 140° C. for 5 minutes to obtain a polyester fabric for ink jet recording.

Using four color inks (yellow, magenta, cyan, black) in which water-insoluble pigments were each dispersed in water, a color pattern was printed by an ink jet method on the polyester fabric by using a ink jet recording head (printing condition; nozzle diameter: 100 $\mu$m, driving voltage: 107 V, frequency: 5 KHz, resolution: 360 dpi, 4 ×4 matrix) of an On-demand-type which jetted ink by a piezoelectric element such that the average amount of ink to be applied was in a range between $1.4\times10^{-2}$ and $5.6\times10^{-2}$ $\mu$l/mm$^2$ to obtain a recording image for evaluation.

Table 1 shows the results of evaluation for the recording characteristics and image characteristics of the ink jet recording polyester fabric formed in this example and the long-term durability and flexibility of the substrate. Test methods for each evaluation items are shown below.

Example 2

Synthesis of Water-swelling Resin (A)

279 parts of methyl ethyl ketone and 0.024 parts of dibutyltin dilaurate as a catalyst were introduced into a dehydrated and dried polyol which was the same as that used in Example 1. Next, 14.98 parts of 1,6-hexamethylene diisocyanate (HDI) was added dropwise and the temperature of the mixture was raised gradually to 80° C. The reaction was continued until the ratio of an NCO group reached the theoretical value while the ratio of an NCO group was measured by titration. When the ratio of an NCO group reached the theoretical value, the system was cooled to 25° C. To the cooled mixture was gradually added 478 parts of 25° C. distilled water in which 4.6 parts of a sodium salt of hydrazine sulfite was dissolved and the temperature of the system was then raised to 40° C. to carry out a chain-growing reaction. When almost no residual NCO group was present, the residual NCO group was completely blocked by n-butylamine to finish the reaction. The resulting product was homogenized and dispersed using a homogenizer such that the average particle diameter was 30 nm, followed by distilling methyl ethyl ketone under reduced pressure to obtain a water dispersion solution of the water-swelling resin A having 20% of a solid, a number average molecular weight of 32,300 and a water-swelling rate of 135%.

Synthesis of Water-swelling Resin (B)

206 parts of methyl ethyl ketone and 0.027 parts of a catalyst were introduced into a dehydrated and dried polyol which was the same as that used in Example 1. Next, 31.66 parts of 4,4'-dicyclohexylmethane diisocyanate (hydrogenated MDI) was added dropwise and the mixture was heated gradually to 80° C. The reaction was continued until the ratio of an NCO group reached the theoretical value while the ratio of an NCO group was measured appropriately by titration. When the ratio of an NCO group reached the theoretical value, the system was cooled to 25° C. To the cooled mixture was gradually added 320 parts of 25° C. distilled water in which 5.56 parts of a sodium salt of ethylenediamine sulfite was dissolved to carry out a chain-growing reaction. Then, the amount of a residual NCO group in the system was measured and diethyl malonate was added in an amount sufficient to mask the residual NCO group thereby blocking reactive terminal NCO groups to finish the synthesis. The resulting product was homogenized and dispersed using a homogenizer such that the average particle diameter was 30 nm, followed by distilling methyl ethyl ketone under reduced pressure to obtain a water dispersion solution of the water-swelling resin B having 30% of a solid, a number average molecular weight of 6,400 and a water-swelling rate of 125%.

Processing of a Fabric

The following polyester plain weave fabric was used as a substrate.

Density in a longitudinal direction:70 pieces/inch.

Density in a lateral direction: 55 pieces/inch.

Thread: 150 denier/48 filaments.

Weight: 95 g/m$^2$.

Tensile tearing strength: 2.3 kg in both longitudinal lateral directions.

A treating solution was prepared according to the following formulation.

| Formulation of the treating solution: | |
|---|---|
| Water dispersion solution of the resin (A) (concentration of a solid: 20%) | 100 parts |
| Water dispersion solution of the resin (B) (concentration of a solid: 30%) | 20 parts |
| Microparticles (C) (trademark: Triazet Cx260-1, manufactured by Showa Denko K.K. particle diameter: 9 $\mu$m, water absorbance: 2.2 ml/g) | 17 parts |

A recording fabric was produced in the same manner as in Example 1 and the recording fabric was subjected to evaluation.

Comparative Example 1

As a substrate, the same polyester plain weave fabric as that used in Example 1 was used.

Using the resin used in Example 1, a treating solution was prepared according to the following formulation.

| Formulation of the treating solution | |
|---|---|
| Water dispersion solution of the resin (A) (concentration of a solid: 20%) | 130 parts |
| Microparticles (C) (trademark: Sylysia 350, manufactured by Fuji Silysia Chemical Co., Ltd., particle diameter: 1.8 $\mu$m, water absorbance: 1.6 ml/g) | 26 parts |

A treating solution obtained by mixing the above components was applied to a fabric so that the dried weight was 35 g/m$^2$ by a coating method. The resulting product was, after it was subjected to hot air drying, heat-treated at 140° C. for 5 minutes to obtain an objective fabric.

A color pattern was printed by an ink jet method on the recording material in the same manner as in Example 1 to obtain a recording image for evaluation. Table 1 shows the results of evaluation for the recording characteristics and image characteristics of the ink jet recording polyester fabric formed in this example and the long-term durability and flexibility of the substrate. Test methods for each evaluation items are shown below.

Comparative Example 2

As a substrate, the same polyester plain weave fabric as that used in Example 1 was used.

Using the resin used in Example 1, a treating solution was prepared according to the following formulation.

| Formulation of the treating solution | |
|---|---|
| Water dispersion solution of the resin (A) concentration of a solid: 20%) | 100 parts |
| Water dispersion solution of the resin (B) (concentration of a solid: 30%) | 20 parts |

Then, a recording fabric was produced in the same manner as in Comparative Example 1 and was evaluated. The evaluation results are shown in Table 1. Test methods for each evaluation items are shown below.

Comparative Example 3

As a substrate, the same polyester plain weave fabric as that used in Example 1 was used.

Using the resin used in Example 1, a treating solution was prepared according to the following formulation.

| Formulation of the treating solution | |
|---|---|
| Water dispersion solution of the resin (B) (concentration of a solid: 30%) | 87 parts |
| Microparticles (C) (trademark: Sylysia 350, manufactured by Fuji Silysia Chemical Co., Ltd., particle diameter: 1.8 $\mu$m, water absorbance: 1.6 ml/g) | 26 parts |

Then, a recording fabric was produced in the same manner as in Comparative Example 1 and was evaluated.

The evaluation results are shown in Table 1. Test methods for each evaluation items are shown below.

Evaluation method

1. Ink absorbance

After a color pattern was recorded, the recording material was allowed to stand at room temperature to measure a period of time between the time when the color pattern was recorded and the time when the color pattern was dried such that no ink adhered to a finger when the finger touched the image surface.

○: 0–1 minute

Δ: 1–5 minutes

X: over 5 minutes

2. Color density

A color pattern was printed on a commercially available dedicated paper for ink jet and was used as a standard to determine whether or not the pattern recorded on the ink jet recording polyester fabrics prepared in the examples according to the present invention and the comparative examples developed a clean color (whether the surface density is high or not) as compared with the standard.

○: Developed color was clear.

Δ: The density was slightly low, showing subdued color and different color tone.

X: Significantly inferior color development.

3. Reproducibility of dots

The recorded color pattern was observed using a microscope to evaluate a dot pattern.

○: Slight feathering, clean circular shape.

Δ: A little feathering, slightly deformed dot

X: Severe feathering, considerably deformed dot. Long-term durability of the substrate 4. Light resistance Light was applied to a sample at 63° C. for 1,000 hours using a UV-ray carbon arc lamp type fading tester to evaluate a degree of change in color visually.

(JIS K5400)

○: Almost no change was observed.

Δ: Slight change in color was observed

X: Significant change in color (yellowing) was observed.

5. $NO_x$ gas resistance

A sample was allowed to stand in an atmosphere containing 5,000 ppm of $NO_x$ gas for one hour to evaluate a degree of change in color visually.

(Strong test of JIS L0855)

○: Almost no change was observed.

Δ: Slight change in color was observed

X: Significant change in color (yellowing) was observed.

6. Wear resistance (in dry and wet conditions)

A sample was attached to a Scott type folding and abrasing tester to evaluate a degree of abrasion of an image receiving layer visually before and after a load was applied in both dry and wet conditions.

Load and folding conditions: stroke: 5 cm, clamp: 3 cm, load 1 kg×300 times.

Preparation of wet condition: dipped in pure water for 30 minutes→dewatered using a filter paper→folding and abrasing test (JIS L1096) (B method)

○: Significant abrasion was observed(peeling of the image receiving layer was significant).

Δ: Slight abrasion was observed(peeling of a part of the coating was observed).

X: Almost no change was observed. Flexibility

7. Bending characteristics

An operation in which the recording fabric on which a color pattern was recorded was folded firmly in two and then opened was repeated 50 times to evaluate the bending characteristics for a fabric.

○: Soft and easily folded, slight fold wrinkle and almost no whitely faded portion were observed.

Δ: Hard and hard to be folded, many fold wrinkles were observed, the image receiving layer was peeled off and the image was whitely faded.

X: Significant damages to an image caused by the peeling of the image receiving layer were observed.

TABLE 1

The evaluation results of a recording fabric

| | | | Example 1 | Example 2 | Comparative Example 1 | Comparative Example 2 | Comparative Example 3 |
|---|---|---|---|---|---|---|---|
| Image quality | Ink absorbance | | ○ | ○ | ○ | x | Δ |
| | Color density | | ○ | ○ | ○ | Δ | x |
| | Reproducibility of dots | | ○ | ○ | ○ | Δ | Δ |
| Long term durability | Light resistance | | ○ | ○ | ○ | ○ | ○ |
| | $NO_x$ gas resistance | | ○ | ○ | ○ | ○ | ○ |
| | Wear resistance | Dry condition | ○ | ○ | x | ○ | Δ |
| | | Wet condition | ○ | ○ | x | Δ | Δ |
| Bending characteristic | | | ○ | ○ | ○ | ○ | x |
| Overall evaluation | | | ○ | ○ | x | Δ | x |

The present invention can provide a polyester fabric for ink jet recording which attains excellent image qualities, long-term durability, workability (lightweight, highly strong and elastic) and bending characteristics that have not been attained by materials such as paper and a film and which is suitable for large-sized and full color advertising media such as a suspended curtain, a banner, and a cloth signboard regardless of indoor materials or outdoor materials.

What is claimed is:

1. A polyester fabric for ink jet recording comprising:

a water-swelling resin (A) comprising a reaction product of a polycarbonate polyol and a polyisocyanate compound and having a sulfite group at the side chain and a number average molecular weight of 20,000 to 100,000;

a water-swelling resin (B) comprising a reaction product of a polycarbonate polyol and a polyisocyanate compound and having a sulfite group at the side chain and a number average molecular weight of 5,000 to 15,000, wherein a blocking agent is reacted with active isocyanate groups positioned at both terminals of the water-swelling resin to mask the terminal isocyanates; and water-retentive microparticles (C); the fabric being heat-treated.

2. A polyester fabric for ink jet recording according to claim 1, wherein the water-swelling resin (A) contains 1–5% by weight of the sulfite and the water-swelling rate is in a range between 130 and 180%.

3. A polyester fabric for ink jet recording according to claim 2, wherein the water-swelling resin (B) contains 1–5% by weight of the sulfite and the water-swelling rate is in a range between 120 and 160%.

4. A polyester fabric for ink jet recording according to claim 2, wherein the water-retentive microparticles (C) are selected from the group consisting of microparticles of silicic acid produced by a wetting method, microparticles of water-insoluble collagen, and microparticles of calcium alginate and have a water-absorption capacity of 1.2–3.5 ml/g and an average particle diameter of 10 microns or less.

5. A polyester fabric for ink jet recording according to claim 2, wherein the ratio (A)/(B) by weight of the water-swelling resin (A) to the water-swelling resin (B) is in a range between 6/4 and 9/1.

6. A polyester fabric for ink jet recording according to claim 2, wherein the ratio ((A)+(B))/(C) by weight of a mixture of the water-swelling resin (A) and the water-swelling resin (B) to the water-retentive microparticles (C) is in a range between 6/4 and 3/7.

7. A polyester fabric for ink jet recording according to claim 1, wherein the water-swelling resin (B) contains 1–5% by weight of the sulfite and the water-swelling rate is in a range between 120 and 160%.

8. A polyester fabric for ink jet recording according to claim 7, wherein the water-retentive microparticles (C) are selected from the group consisting of microparticles of silicic acid produced by a wetting method, microparticles of water-insoluble collagen, and microparticles of calcium alginate and have a water-absorption capacity of 1.2–3.5 ml/g and an average particle diameter of 10 microns or less.

9. A polyester fabric for ink jet recording according to claim 7 wherein the ratio (A)/(B) by weight of the water-swelling resin (A) to the water-swelling resin (B) is in a range between 6/4 and 9/1.

10. A polyester fabric for ink jet recording according to claim 3, wherein the ratio ((A)+(B))/(C) by weight of a mixture of the water-swelling resin (A) and the water-swelling resin (B) to the water-retentive microparticles (C) is in a range between 6/4 and 3/7.

11. A polyester fabric for ink jet recording according to claim 1, wherein the water-retentive microparticles (C) are selected from the group consisting of microparticles of silicic acid produced by a wetting method, microparticles of water-insoluble collagen, and microparticles of calcium alginate and has a water-absorption capacity of 1.2–3.5 ml/g and an average particle diameter of 10 $\mu$m or less.

12. A polyester fabric for ink jet recording according to claim 11, wherein the ratio (A)/(B) by weight of the water-swelling resin (A) to the water-swelling resin (B) is in a range between 6/4 and 9/1.

13. A polyester fabric for ink jet recording according to claim 11, wherein the ratio ((A)+(B))/(C) by weight of a mixture of the water-swelling resin (A) and the water-swelling resin (B) to the water-retentive microparticles (C) is in a range between 6/4 and 3/7.

14. A polyester fabric for ink jet recording according to claim 1, wherein the ratio (A)/(B) by weight of the water-swelling resin (A) to the water-swelling resin (B) is in a range between 6/4 and 9/1.

15. A polyester fabric for ink jet recording according to claim 14, wherein the ratio ((A)+(B))/(C) by weight of a mixture of the water-swelling resin (A) and the water-swelling resin (B) to the water-retentive microparticles (C) is in a range between 6/4 and 3/7.

16. A polyester fabric for ink jet recording according to claim 1, wherein the ratio ((A)+(B)) (C) by weight of a mixture of the water-swelling resin (A) and the water-swelling resin (B) to the water-retentive microparticles (C) is in a range between 6/4 and 3/7.

17. A process for producing a polyester fabric for ink jet recording comprising applying to a polyester fabric a treating solution consisting essentially of:

a water dispersion solution of a water-swelling resin (A) comprising a reaction product of a polycarbonate polyol and a polyisocyanate compound and having a sulfite group at the side chain and a number average molecular weight of 20,000 to 100,000;

a water dispersion solution of a water-swelling resin (B) comprising a reaction product of a polycarbonate polyol and a polyisocyanate compound and having a sulfite group at the side chain and a number average molecular weight of 5,000 to 15,000, wherein a blocking agent is reacted with active isocyanate groups positioned at both terminals of the water-swelling resin to mask the terminal isocyanates; and water-retentive microparticles (C); and heat-treating the fabric at 120 to 160° C.

18. A process for producing a polyester fabric for ink jet recording according to claim 17, wherein the water-swelling resin (A) and the water-swelling resin (B) are microparticles having a particle diameter of 10 to 50 nm.

* * * * *